US007621342B2

(12) United States Patent
Walker

(10) Patent No.: US 7,621,342 B2
(45) **Date of Patent: *Nov. 24, 2009**

(54) METHOD FOR RETAINING DEBRIS IN A PERFORATING APPARATUS

(75) Inventor: Jerry L. Walker, Azle, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/201,287

(22) Filed: Aug. 29, 2008

(65) Prior Publication Data

US 2009/0050323 A1 Feb. 26, 2009

Related U.S. Application Data

(62) Division of application No. 10/961,703, filed on Oct. 8, 2004, now Pat. No. 7,430,965.

(51) Int. Cl.
*E21B 43/116* (2006.01)
*F42B 1/02* (2006.01)

(52) U.S. Cl. ..... 175/4.55; 175/4.6; 102/310; 102/313; 102/321; 89/1.15

(58) Field of Classification Search ..... 166/297, 166/299, 55.2, 55.1; 175/2, 4.55, 4.6; 89/1.15, 89/1.151; 102/320, 321, 310
See application file for complete search history.

(56) References Cited

U.S. PATENT DOCUMENTS

| | | | |
|---|---|---|---|
| 2,849,953 | A | 9/1958 | Delacour |
| 2,947,250 | A | 8/1960 | Mohaupt |
| 2,994,269 | A | 8/1961 | Schlumberger |
| 3,057,295 | A | 10/1962 | Christopher |
| 3,282,354 | A | 11/1966 | Hakala et al. |
| 3,429,384 | A | 2/1969 | Shore |
| 3,650,212 | A | 3/1972 | Bauer |
| 4,191,265 | A | 3/1980 | Bosse-Platiere |
| 4,312,273 | A | 1/1982 | Camp |
| 4,467,878 | A | 8/1984 | Ibsen |
| 4,534,423 | A | 8/1985 | Regalbuto |
| 4,583,602 | A | 4/1986 | Ayers |
| 4,726,431 | A | 2/1988 | Oestreich et al. |
| 4,756,371 | A | 7/1988 | Brieger |
| 4,773,299 | A | 9/1988 | Oestreich et al. |
| 4,832,134 | A | 5/1989 | Gill |
| 4,960,171 | A | 10/1990 | Parrott et al. |

(Continued)

*Primary Examiner*—Kenneth Thompson
*Assistant Examiner*—David Andrews
(74) *Attorney, Agent, or Firm*—Lawrence R. Youst

(57) ABSTRACT

A perforating apparatus (100) includes a plurality of shaped charges (102) each having an initiation end and a discharge end. A detonating cord (116) is operably coupled to the initiation ends of the shaped charges (102). A carrier (106) contains the shaped charges (102). The carrier (106) includes at least one discharge location corresponding to the discharge ends of the shaped charges (102) when the perforating apparatus (100) is in its operable position. The discharge location has first and second material layers (122, 124) wherein the second material layer (124) exhibits resilient recovery such that an opening created by a jet formed from detonating one of the shaped charges (102) in the second material layer (124) is smaller than an opening created by the jet in the first material layer (122), thereby retaining debris in the perforating apparatus (100) with the second material layer (124).

20 Claims, 8 Drawing Sheets

U.S. PATENT DOCUMENTS

| | | | |
|---|---|---|---|
| 5,054,564 | A | 10/1991 | Oestreich et al. |
| 5,775,426 | A | 7/1998 | Snider et al. |
| 6,497,285 | B2 | 12/2002 | Walker |
| 6,595,290 | B2 | 7/2003 | George et al. |
| 6,865,978 | B2 | 3/2005 | Kash |
| 6,926,096 | B2 | 8/2005 | Kash |
| 7,055,421 | B2 | 6/2006 | Kash |
| 7,360,587 | B2 | 4/2008 | Walker et al. |
| 7,360,599 | B2 | 4/2008 | Walker et al. |
| 7,430,965 | B2 | 10/2008 | Walker |
| 2008/0230225 | A1 * | 9/2008 | Meddes et al. ..... 166/297 |

* cited by examiner

METHOD FOR RETAINING DEBRIS IN A PERFORATING APPARATUS

CROSS-REFERENCE TO RELATED APPLICATIONS

This is a divisional application of and claims priority to U.S. patent application No. 10/961,703, filed Oct. 8, 2004 now U.S. Pat. No. 7,430,965, entitled "Debris Retention Perforating Apparatus and Method for Use of Same."

TECHNICAL FIELD OF THE INVENTION

This invention relates, in general, to perforating a subterranean wellbore using shaped charges and, in particular, to a method for retaining debris in a perforating apparatus by reducing the size of the holes made in the charge carrier following the detonation of the shaped charges.

BACKGROUND OF THE INVENTION

Without limiting the scope of the present invention, its background will be described with reference to perforating a subterranean formation with a shape charge perforating apparatus, as an example.

After drilling the section of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic opening or perforation must be made through the casing string, the cement and a short distance into the formation.

Typically, these perforations are created by detonating a series of shaped charges located within the casing string that are positioned adjacent to the formation. Specifically, one or more charge carriers are loaded with shaped charges that are connected with a detonating device, such as detonating cord. The charge carriers are then connected within a tool string that is lowered into the cased wellbore at the end of a tubing string, wireline, slick line, coil tubing or the like. Once the charge carriers are properly positioned in the wellbore such that shaped charges are adjacent to the formation to be perforated, the shaped charges are detonated. Upon detonation, each shaped charge creates a jet that blasts through a scallop or recess in the carrier. Each jet creates a hydraulic opening through the casing and the cement and enters the formation forming a perforation.

When the shaped charges are detonated, numerous metal fragments are created due to, among other things, the disintegration of the metal casings of the shaped charges. These fragments often fall out or are blown out of the holes created in the carrier. As such, these fragments become debris that is left behind in the wellbore. It has been found that this debris can obstruct the passage of tools through the casing during subsequent operations. This is particularly problematic in the long production zones that are perforated in horizontal wells as the debris simply piles up on the lower side of such wells.

A need has therefore arisen for an apparatus and method that reduce the likelihood that debris will be left in the well following perforation of the formation. A need has also arisen for such an apparatus and method that will contain the fragments created when the shaped charges are detonated. Further, a need has arisen for such an apparatus and method that will enhance the performance of the shaped charges in perforating the formation.

SUMMARY OF THE INVENTION

The present invention disclosed herein comprises a debris retention perforating apparatus and a method for retaining debris in a perforating apparatus used to perforate a subterranean well. The perforating apparatus of the present invention achieves this result by containing the fragments created when the shaped charges are detonated.

The perforating apparatus of the present invention comprises a carrier having at least one discharge location. The discharge location has first and second material layers, one of which exhibits resilient recovery. At least one shaped charge is positioned within the carrier. The shaped charge has an initiation end and a discharge end. The discharge end of the shaped charge is substantially aligned with the at least one discharge location. A detonating cord is operably to initiate a detonation of the at least one shaped charge such that a jet is formed that travels through the discharge location. The resulting opening created by the jet in the material layer exhibiting resilient recovery is smaller than an opening created by the jet in the other material layer, thereby retaining debris in the perforating apparatus with the material exhibiting resilient recovery.

In one embodiment of the perforating apparatus of the present invention, one of the first and second material layers is a metal layer while the other of the material layers is a polymeric layer. In another embodiment, one of the first and second material layers is a metal layer while the other of the material layers is an elastomeric layer. In yet another embodiment, one of the first and second material layers is a metal layer while the other of the material layers is a rubber layer.

In one embodiment of the perforating apparatus of the present invention, the material layer to the exterior exhibits resilient recovery. In another embodiment, the material layer to the interior exhibits resilient recovery. In yet another embodiment, the material layer exhibiting resilient recovery is at least partially positioned within a circumferential groove in the carrier, which may have a contoured bottom surface. In a further embodiment, the material layer exhibiting resilient recovery is at least partially positioned within a recess in the carrier, which may have a contoured bottom surface. In yet a further embodiment, the material layer exhibiting resilient recovery may be a sleeve. In any of the above embodiments, the material layer exhibiting resilient recovery may be at least partially secured to the other material layer using a crosslinking reaction.

In another aspect, the present invention is directed to a perforating apparatus that comprises at least one shaped charge having an initiation end and a discharge end, a detonating cord that is operably coupled to the initiation end of the shaped charge and a carrier that contains the shaped charge. The carrier includes at least one discharge location corresponding to the discharge end of the shaped charge when the perforating apparatus is in its operable position. The discharge location has first and second material layers wherein an opening created by a jet formed from detonating the shaped charge in the second material layer is smaller than an opening created by the jet in the first material layer.

In a further aspect, the present invention is directed to a carrier for a perforating apparatus that comprises an elongated tubular member having at least one discharge location corresponding to the discharge end of a shaped charge when the perforating apparatus is in its operable position. The discharge location has first and second material layers wherein an opening created by a jet formed from detonating the shaped charge in the second material layer is smaller than an opening created by the jet in the first material layer.

In yet another aspect, the present invention is directed to a method for retaining debris in a perforating apparatus used to perforate a subterranean well that includes running the perforating apparatus downhole, detonating a shaped charge contained within a carrier of the perforating apparatus and discharging a jet formed from the shaped charge through a discharge location of the carrier such that an opening is created through first and second material layers of the discharge location, wherein the opening in the first material layer is larger than the opening in the second material layer, thereby retaining debris in the perforating apparatus with the second material layer.

In yet a further aspect, the present invention is directed to a method for retaining debris in a perforating apparatus used to perforate a subterranean well that includes running the perforating apparatus downhole, detonating a shaped charge contained within a carrier of the perforating apparatus and discharging a jet formed from the shaped charge through a discharge location of the carrier such that an opening is created through first and second material layers of the discharge location, wherein the second material layer exhibits resilient recovery, thereby retaining debris in the perforating apparatus with the second material layer.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
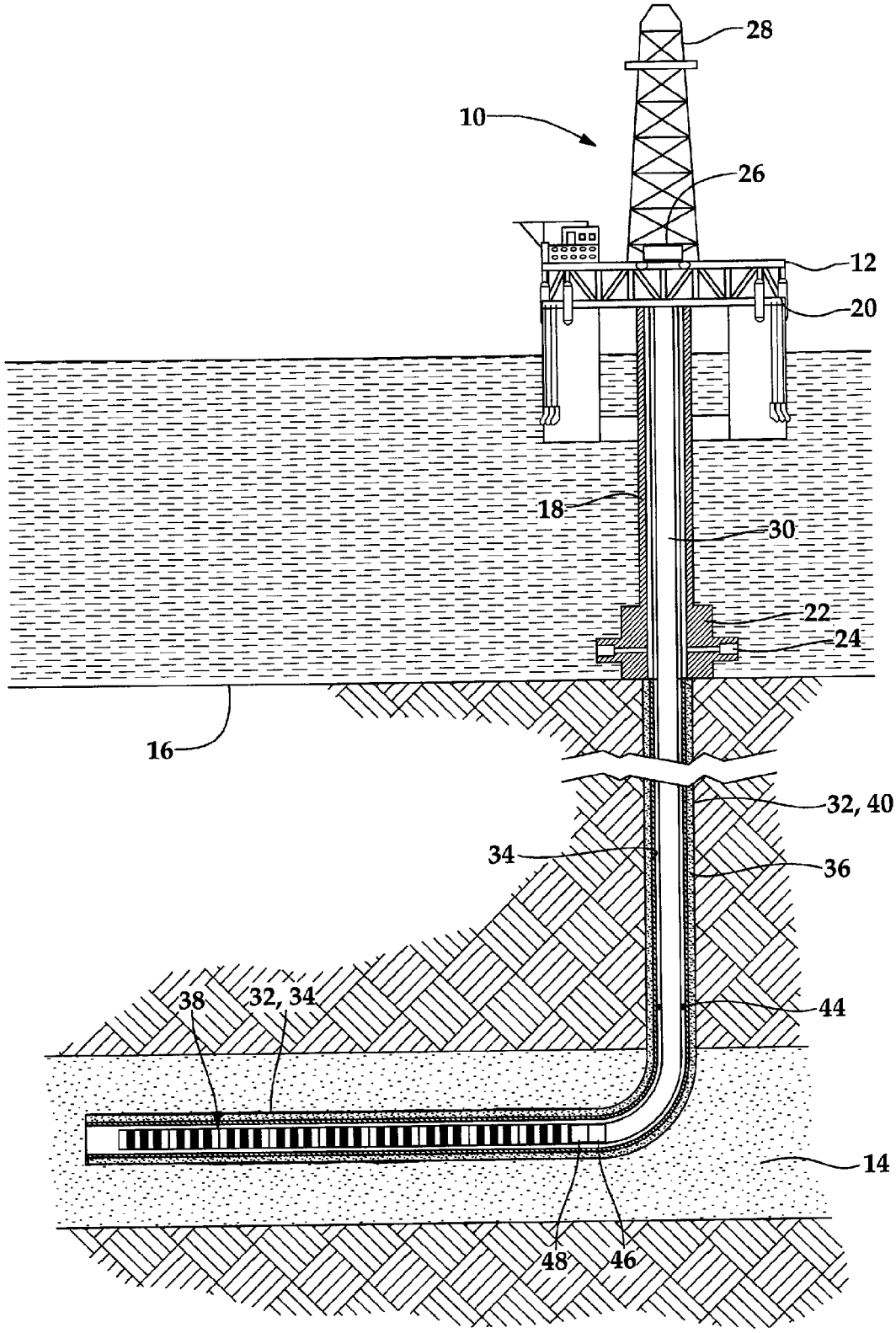
FIG. 1 is a schematic illustration of an offshore oil and gas platform operating a debris retention perforating apparatus of the present invention.

Referring initially to FIG. 1, a debris retention perforating apparatus operating from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including subsea blow-out preventers 24. Platform 12 has a hoisting apparatus 26 and a derrick 28 for raising and lowering pipe strings such as work sting 30.

A wellbore 32 extends through the various earth strata including formation 14. A casing 34 is cemented within wellbore 32 by cement 36. Work string 30 includes various tools such as a plurality of perforating guns 38. When it is desired to perforate casing 34, work string 30 is lowered through casing 34 until the perforating guns 38 are properly positioned relative to formation 14. Thereafter, the shaped charges within the string of perforating guns 38 are sequentially fired, either in an uphole to downhole or a downhole to uphole direction. Upon detonation, the liners of the shaped charges form jets that create a spaced series of perforations extending outwardly through casing 34, cement 36 and into formation 14, thereby allow fluid communication between formation 14 and wellbore 32.

In the illustrated embodiment, wellbore 32 has an initial, generally vertical portion 40 and a lower, generally deviated portion 42 which is illustrated as being horizontal. It should be noted, however, by those skilled in the art that the debris retention perforating guns of the present invention are equally well-suited for use in other well configurations including, but not limited to, inclined wells, wells with restrictions, non-deviated wells and the like.

Work string 30 includes a retrievable packer 44 that may be sealingly engaged with casing 34 in vertical portion 40 of wellbore 32. At the lower end of work string 30 is the gun string including the plurality of perforating guns 38, a ported nipple 46 and a time domain fire device 48. In the illustrated embodiment, perforating guns 38 are preferably internally oriented perforating guns which allow for increased reliability in orienting the shaped charges to shoot in the desired direction or directions as described in U.S. Pat. No. 6,595,290 issued to Halliburton Energy Services, Inc. on Jul. 22, 2003, which is hereby incorporated by reference for all purposes.

Figure 2:
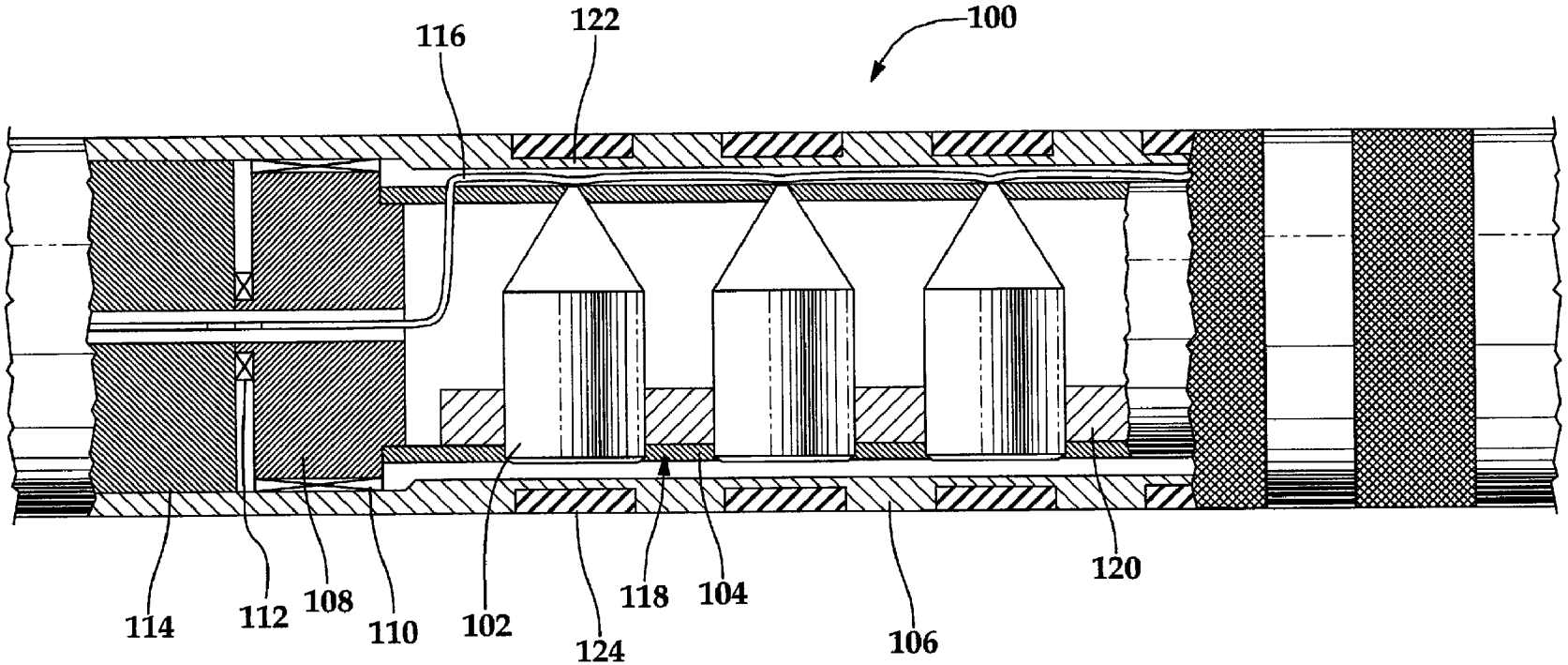
FIG. 2 is partial cut away view of one embodiment of a debris retention perforating apparatus of the present invention.

Referring now to FIG. 2, therein is depicted a debris retention perforating apparatus of the present invention that is generally designated 100. In the following description of perforating apparatus 100 as well as the other apparatuses and methods described herein, directional terms such as "above", "below", "upper", "lower" and the like are used for convenience in referring to the illustrations as it is to be understood that the various examples of the invention may be used in various orientations such as inclined, inverted, horizontal, vertical and the like and in various configurations, without departing from the principles of the invention.

Perforating apparatus 100 includes a plurality of shaped charges 102. Each of the shaped charges 102 includes an outer housing, a liner and a quantity of high explosive disposed therebetween. Shaped charges 102 are mounted within a tubular structure 104 in a gun carrier 106. Gun carrier 106 is preferable a cylindrical tubing formed from a metal such as steel. Charge mounting structure 104 is preferably made from cylindrical tubing, but it should be understood that it is not necessary for the structure to be tubular, or for the structure to be cylinder shaped, in keeping with the principles of the invention. For example, structure 104 could be made of formed sheet metal.

Structure 104 is rotatably supported in gun carrier 106 by multiple supports 108, only one such support 108 being visible in FIG. 2. Each of the supports 108 is connected to an end of structure 104. This manner of rotatably supporting structure 104 at ends thereof prevents shaped charges 102 and structure 104 from contacting the interior of gun carrier 106. Charges 102 are thereby permitted to reliably rotate within gun carrier 106, regardless of the combined length of the one or more structures 104 in the gun carrier.

Each of the supports 108 includes rolling elements or bearings 110 contacting the interior of carrier 106. For example, the bearings 110 could be ball bearings, roller bearings, plain bearings or the like. Bearings 110 enable supports 108 to suspend structure 104 in carrier 106 and permit rotation of structure 104. In addition, thrust bearings 112 are positioned between structure 104 at each end of carrier 106 and devices 114 attached at each end of carrier 106. Devices 114 may be tandems used to couple two guns to each other, a bull plug used to terminate a gun string, a firing head, or any other type of device which may be attached to a gun carrier. As with bearings 110 described above, the thrust bearings 112 may be any type of suitable bearings. Thrust bearings 112 support structure 104 against axial loading in carrier 106, while permitting structure 104 to rotate in carrier 106.

In the illustrated embodiment, gravity is used to rotate charges 102 within carrier 106. It is to be clearly understood, however, that other means may be used to rotate charges 102 in keeping with the principles of the invention including, but not limited to, an electric motor, a hydraulic actuator or the like.

Structure 114, charges 102 and other portions of perforating apparatus 100 supported in carrier 106 by supports 108 including, for example, a detonating cord 116 extending to each of the charges and portions of the supports themselves are parts of an overall rotating assembly 118. By laterally offsetting the center of gravity of assembly 118 relative to a longitudinal rotational axis passing through perforating apparatus 100 which is the rotational axis of bearings 110, assembly 118 is biased by gravity to rotate to a specific position in which the center of gravity is located directly below the rotational axis.

Assembly 118 may, due to the construction of the various elements thereof, initially have a center of gravity in a desired position relative to charges 102, however, to ensure that charges 102 are directed to shoot in the desired predetermined direction or directions, the center of gravity may be repositioned, or the biasing exerted by gravity may be enhanced, by adding one or more weights 120 to assembly 118. As illustrated, weights 120 are added to assembly 118 to direct charges 102 to shoot downward. Of course, weights 120 may be otherwise positioned to direct charges 102 to shoot in any desired direction, or combination of directions.

Carrier 106 is provided with reduced wall thickness portions 122, which circumscribe each of the charges 102. Portions 122 extend circumferentially about carrier 106 outwardly overlying each of the charges 102. Thus, as charges 102 rotate within carrier 106, they remain directed to shoot through portions 122. As such, the jets formed upon detonation of the charges 102 pass through portions 122 at discharge locations.

Importantly, disposed within each portion 122 is a resilient element 124. Elements 124 of the present invention may be formed from a polymeric material that, over a range of temperatures, is capable of recovering substantially in shape and size after removal of a deforming force. In one embodiment, the polymeric material exhibits certain physical and mechanical properties relative to elastic memory and elastic recovery. Accordingly, elements 124 of the present invention preferably comprise elastomers, rubbers or other similarly resilient materials. Elements 124 may be subjected to a crosslinking reaction to increase the strength and resiliency of the material and to secure elements 124 within portions 122. The crosslinking reaction may be vulcanization, a radiation crosslinking reaction, a photochemical crosslinking reaction, a chemical crosslinking reaction or other suitable reaction. As such, the jets formed upon detonation of the charges 102 pass through portions 122 as well as elements 124 at the discharge locations.

As stated above, when charges 102 are detonated to perforate the casing, numerous metal fragments are created due to the disintegration of the metal outer housing of shaped charges 102. In conventional perforating apparatuses, these fragments often fall out or are blown out of the holes created in the carrier and become debris that is left behind in the wellbore. In the present invention, however, the resulting hole size of the discharge locations created by the perforating jets is smaller than with a conventional perforating apparatus. Specifically, the discharge hole created by the perforating jets passes through two material layers; namely, the metal layer of the reduced wall thickness portions 122 of carrier 106 and the resilient layer of elements 124. As the jets impact elements 124, an opening is formed therethrough, however, a portion of the jets' energy deforms elements 124. Accordingly, once the jets have completely passes through elements 124, elements 124 experience resilient recovery such that the openings through elements 124 are smaller than the openings through portions 122. Due to the reduced size of the openings, more of the metal housing fragments created during perforating are contained with carrier 106, thereby reducing the debris that is left behind in the wellbore.

Figure 3:
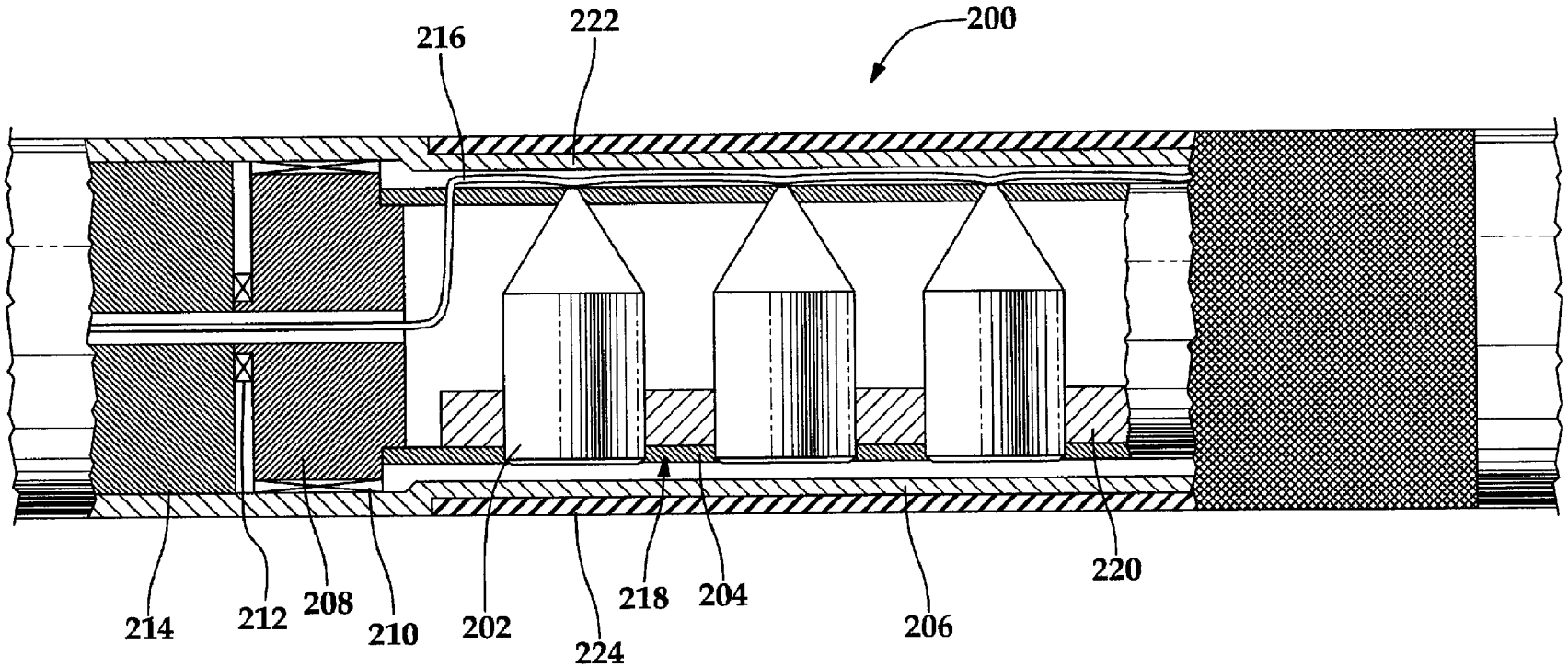
FIG. 3 is partial cut away view of another embodiment of a debris retention perforating apparatus of the present invention.

Referring next to FIG. 3, therein is depicted a debris retention perforating apparatus of the present invention that is generally designated 200. Perforating apparatus 200 includes a plurality of shaped charges 202 mounted within a tubular structure 204 that is rotatable with a gun carrier 206 via supports 208. Each of the supports 208 includes rolling elements or bearings 210 contacting the interior of carrier 206 and thrust bearings 212 are positioned between structure 204 at each end of carrier 206 and devices 214 attached at each end of carrier 206. In this configuration, gravity is used to rotate charges 202 within carrier 206.

Structure 204, charges 202 and other portions of perforating apparatus 200 supported in carrier 206 by supports 208 including, for example, a detonating cord 216 extending to each of the charges and portions of the supports themselves are parts of an overall rotating assembly 218. To ensure that charges 202 are directed to shoot in the desired predetermined directions, the center of gravity may be repositioned, or the biasing exerted by gravity may be enhanced, by adding one or more weights 220 to assembly 218. As illustrated, weights 220 are added to assembly 218 to direct charges 202 to shoot downward.

Carrier 206 is provided with a reduced wall thickness region 222, which extends along the outer portion of carrier 206 radially outwardly of charges 202. Disposed within region 222 is a resilient element 224 capable of recovering substantially in shape and size after removal of a deforming force. Element 224 may be subjected to a crosslinking reaction to increase the strength and resiliency of the material and to secure element 224 within region 222. As such, the jets formed upon detonation of charges 202 pass through region 222 as well as element 224 at a plurality of discharge locations. Accordingly, once the jets have completely passes through element 224, element 224 experience resilient recovery such that the openings through element 224 are smaller than the openings through region 222, thereby containing more fragments within carrier 206 and reducing the debris that is left behind in the wellbore.

Figure 4:
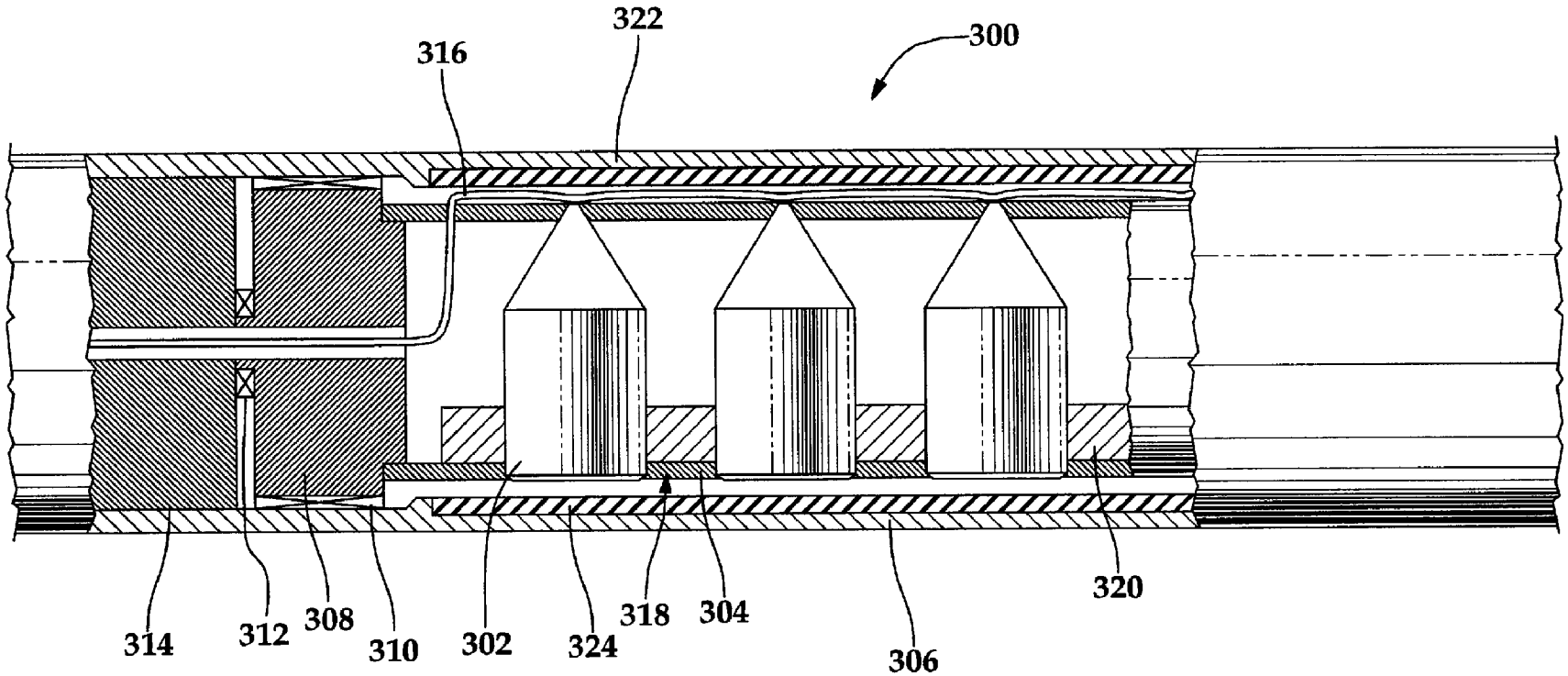
FIG. 4 is partial cut away view of yet another embodiment of a debris retention perforating apparatus of the present invention.

Referring next to FIG. 4, therein is depicted a debris retention perforating apparatus of the present invention that is generally designated 300. Perforating apparatus 300 includes a plurality of shaped charges 302 mounted within a tubular structure 304 that is rotatable with a gun carrier 306 via supports 308. Each of the supports 308 includes rolling elements or bearings 310 contacting the interior of carrier 306 and thrust bearings 312 are positioned between structure 304 at each end of carrier 306 and devices 314 attached at each end of the carrier. In this configuration, gravity is used to rotate charges 302 within carrier 306.

Structure 304, charges 302 and other portions of perforating apparatus 300 supported in carrier 306 by supports 308 including, for example, a detonating cord 316 extending to each of the charges and portions of the supports themselves are parts of an overall rotating assembly 318. To ensure that charges 302 are directed to shoot in the desired predetermined directions, the center of gravity may be repositioned, or the biasing exerted by gravity may be enhanced, by adding one or more weights 320 to assembly 318. As illustrated, weights 320 are added to assembly 318 to direct charges 302 to shoot downward.

Carrier 306 is provided with a reduced wall thickness region 322, which extends along the inner portion of carrier 306 radially outwardly of charges 302. Disposed within region 322 is a resilient element 324 capable of recovering substantially in shape and size after removal of a deforming force. Element 324 may be subjected to a crosslinking reaction to increase the strength and resiliency of the material and to secure element 324 within region 322. As such, the jets formed upon detonation of the charges 302 pass through element 324 as well as region 322 at a plurality of discharge locations. Accordingly, once the jets have completely passes through element 324, element 324 experience resilient recovery such that the openings through element 324 are smaller than the openings through region 322, thereby containing more fragments within carrier 306 and reducing the debris that is left behind in the wellbore.

Figure 5:
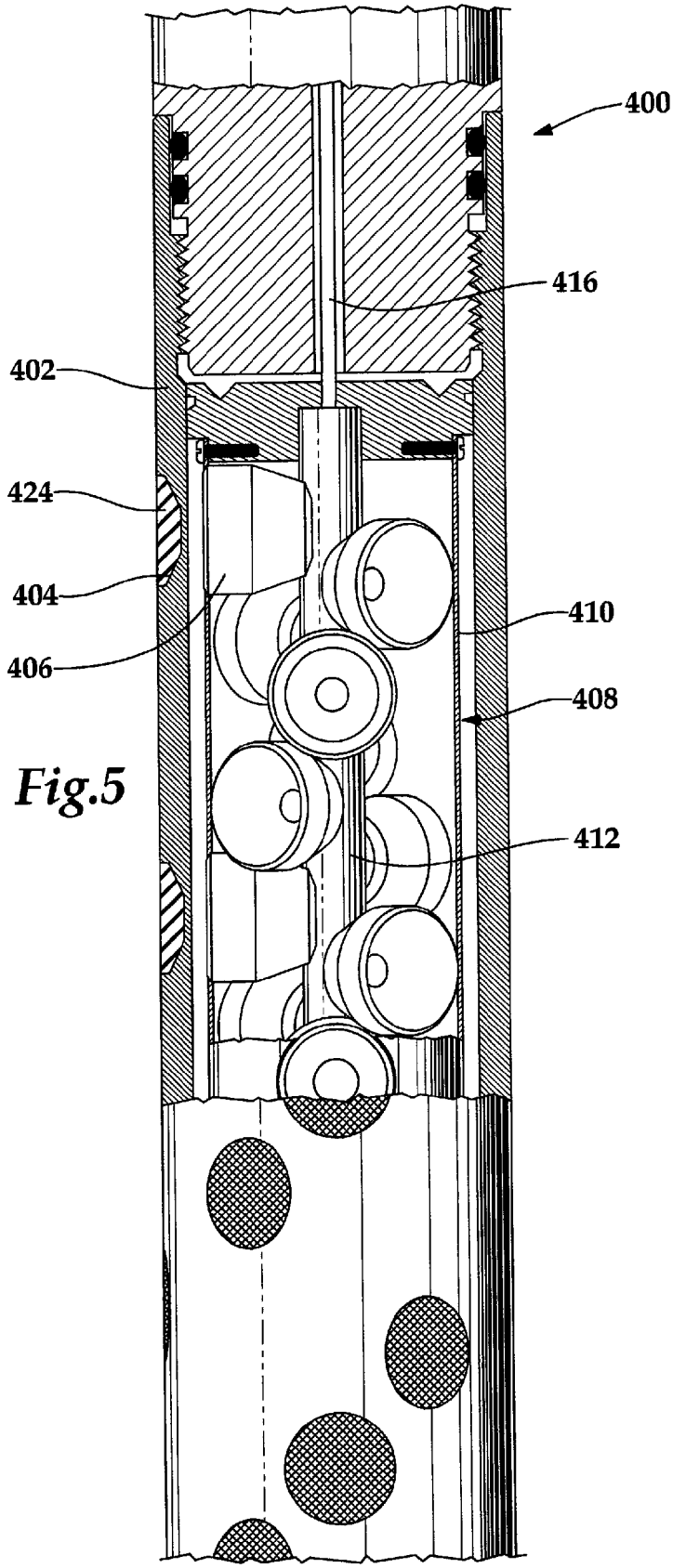
FIG. 5 is partial cut away view of a further embodiment of a debris retention perforating apparatus of the present invention.

Referring next to FIG. 5, therein is depicted a debris retention perforating apparatus of the present invention that is generally designated 400. Perforating apparatus 400 includes a carrier 402 having a plurality of recesses, such as recess 404, defined therein. Radially aligned with each of the recesses is a respective one of the plurality of shaped charges, such as shaped charge 406.

The shaped charges are retained within carrier 402 by a support member 408 which includes an outer charge holder sleeve 410 and an inner charge holder sleeve 412. In this configuration, outer tube 410 supports the discharge ends of the shaped charges, while inner tube 412 supports the initiation ends of the shaped charges. Disposed within inner tube 412 is a detonating cord 416. In the illustrated embodiment, the initiation ends of the shaped charges extend across the central longitudinal axis of perforating apparatus 400 allowing detonating cord 416 to connect to the high explosive within the shaped charges through an aperture defined at the apex of the housings of the shaped charges.

Each of the shaped charges, such as shaped charge 406, is longitudinally and radially aligned with a recess, such as recess 404, in carrier 402 when perforating apparatus 400 is fully assembled. In the illustrated embodiment, the shaped charges are arranged in a spiral pattern such that each shaped charge is disposed on its own level or height and is to be individually detonated so that only one shaped charge is fired at a time. It should be noted, however, by those skilled in the art that alternate arrangements of shaped charges may be used, including cluster type designs wherein more than one shaped charge is at the same level and is detonated at the same time, without departing from the principles of the present invention.

Disposed within recess 404 is a resilient element 424 capable of recovering substantially in shape and size after removal of a deforming force. Elements 424 may be subjected to a crosslinking reaction to increase the strength and resiliency of the material and to secure elements 424 within recesses 404. As such, the jets formed upon detonation of the charges 406 pass through recesses 404 as well as elements 424 at the discharge locations. Accordingly, once the jets have completely passes through elements 424, elements 424 experience resilient recovery such that the openings through elements 424 are smaller than the openings through recesses 404, thereby containing more fragments within carrier 402 and reducing the debris that is left behind in the wellbore.

Figure 6:
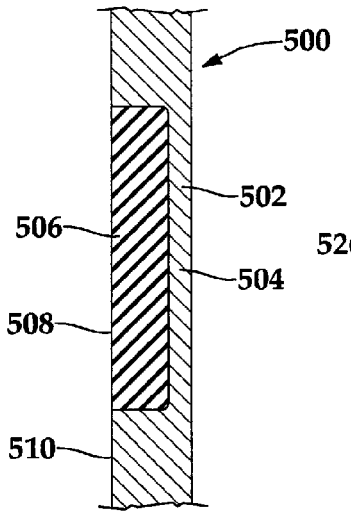
FIG. 6 is a cross sectional view of a discharge location of a carrier of a debris retention perforating apparatus of the present invention.

Referring now to FIG. 6, therein is depicted a cross sectional view of a carrier of a debris retention perforating apparatus of the present invention that is generally designated 500. Carrier 500 has a discharge location 502 which may represent a reduced wall thickness portion such as that described above with reference to FIG. 2 or a recess such as that described above with reference to FIG. 5. Discharge location 502 includes a metal layer 504 and a resilient layer 506. In the illustrated embodiment, resilient layer 506 has a substantially rectangular cross section and is formed such that its outer surface 508 conforms substantially with the outer surface 510 of carrier 500. As described above, resilient layer 506 may be subjected to a crosslinking reaction to increase the strength and resiliency of the material and to secure resilient layer 506 to metal layer 504. Alternatively, it may be desirable to prevent attachment of some portions of resilient layer 506 to metal layer 504. For example, it may be desirable to allow freedom of movement between resilient layer 506 and metal layer 504 at and around the location of jet penetration.

Figure 7:
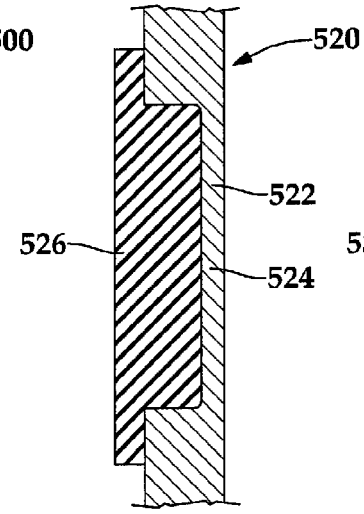
FIG. 7 is a cross sectional view of a discharge location of a carrier of a debris retention perforating apparatus of the present invention.

Referring now to FIG. 7, therein is depicted a cross sectional view of a carrier of a debris retention perforating apparatus of the present invention that is generally designated 520. Carrier 520 has a discharge location 522 which may represent a reduced wall thickness portion such as that described above with reference to FIG. 2 or a recess such as that described above with reference to FIG. 5. Discharge location 522 includes a metal layer 524 and a resilient layer 526. In the illustrated embodiment, resilient layer 526 extends outwardly from discharge location 522 and along the outer surface of carrier 520. In this embodiment, resilient layer 526 may be subjected to a crosslinking reaction to increase the strength and resiliency of the material and to secure resilient layer 526 to metal layer 524 or the outer surface of carrier 520 or both.

Figure 8:
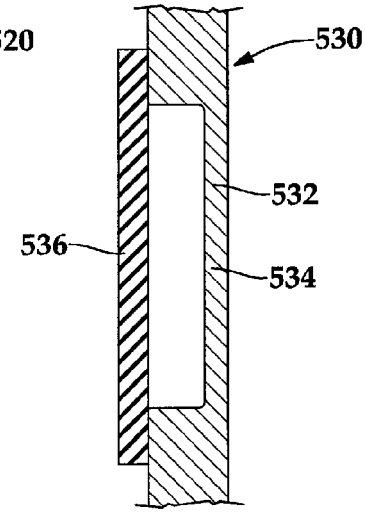
FIG. 8 is a cross sectional view of a discharge location of a carrier of a debris retention perforating apparatus of the present invention.

Referring now to FIG. 8, therein is depicted a cross sectional view of a carrier of a debris retention perforating apparatus of the present invention that is generally designated 530. Carrier 530 has a discharge location 532 which may represent a reduced wall thickness portion such as that described above with reference to FIG. 2 or a recess such as that described above with reference to FIG. 5. Discharge location 532 includes a metal layer 534 and a resilient layer 536. In the illustrated embodiment, resilient layer 536 extends outwardly from discharge location 532 along the outer surface of carrier 530 but does not contact metal layer 534. In this embodiment, resilient layer 536 may be subjected to a crosslinking reaction to increase the strength and resiliency of the material and to secure resilient layer 536 the outer surface of carrier 530.

Figure 9:
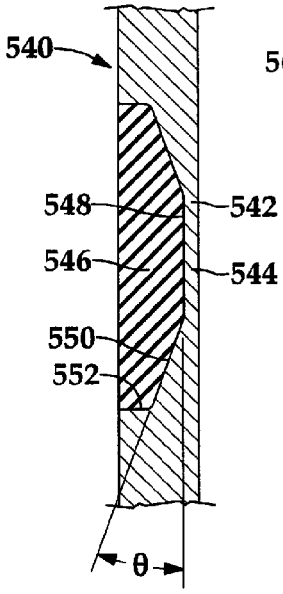
FIG. 9 is a cross sectional view of a discharge location of a carrier of a debris retention perforating apparatus of the present invention.

Referring now to FIG. 9, therein is depicted a cross sectional view of a carrier of a debris retention perforating apparatus of the present invention that is generally designated 540. Carrier 540 has a discharge location 542 which may represent a reduced wall thickness portion such as that described above with reference to FIG. 2 or a recess such as that described above with reference to FIG. 5. Discharge location 542 includes a metal layer 544 and a resilient layer 546. In the illustrated embodiment, metal layer 544 has a contoured bottom surface including a flat bottom center portion 548 and radially outwardly extending from flat bottom center portion 548 is angular bottom portion 550. Angular bottom portion 550 extends radially outwardly toward sidewall portion 552. As such, the thickness of metal layer 544 is at a minimum and the thickness of resilient layer 546 is at a maximum at and around the location of jet penetration through discharge location 542.

In the illustrated embodiment, the angle of angular bottom portion 550 relative to flat bottom portion 548 is angle θ. Angle θ may be any angle greater than zero but is preferably between 10 degrees and 40 degrees and most preferably between 15 degrees and 25 degrees. The exact angle θ will depend upon the desired performance characteristics of discharge location 542. Utilizing carrier 540 having discharge location 542 with metal layer 544 including a contoured bottom surface enhances the performance of a shaped charge for which metal layer 544 is the first target. Specifically, using metal layer 544 with a contoured bottom surface allow the required pressure rating to be achieved even though the metal in flat bottom center portion 548 is thinner than would otherwise be allowable. As such, since the first metal target seen by a shaped charge has a reduced thickness, the performance of such a shaped charge is improved as the depth of penetration into a formation is increased.

Use of such a contoured bottom surface reduces the likelihood that debris will be left in the wellbore following perforation. Specifically, a smaller opening is made when a jet passes through the contoured bottom surface than when a jet passes through a thicker metal layer. With metal layer 544, not only does the jet pass through a thinner metal section, the contoured bottom surface is not susceptibly to the longitudinal pealing effect as the thickness of metal layer 544 becomes progressive thicker in angular bottom portion 550. In addition, as resilient layer 546 may be thicker at and around the location of jet penetration, a greater reduction in the size of the opening through resilient layer 546 is also achieved, thereby further reducing the debris that is left behind in the wellbore.

Figure 10:
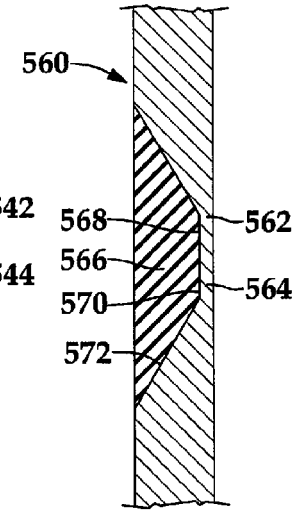
FIG. 10 is a cross sectional view of a discharge location of a carrier of a debris retention perforating apparatus of the present invention.

Referring now to FIG. 10, therein is depicted a cross sectional view of a carrier of a debris retention perforating apparatus of the present invention that is generally designated 560. Carrier 560 has a discharge location 562 which may represent a reduced wall thickness portion such as that described above with reference to FIG. 2 or a recess such as that described above with reference to FIG. 5. Discharge location 562 includes a metal layer 564 and a resilient layer 566. In the illustrated embodiment, metal layer 564 has a contoured bottom surface 568 that has a flat bottom center portion 570 and an angular bottom portion 572. Angular bottom portion 572 extends radially outwardly to the exterior surface of carrier 560. As such, the thickness of metal layer 564 is at a minimum and the thickness of resilient layer 566 is at a maximum at and around the location of jet penetration through discharge location 562.

Figure 11:
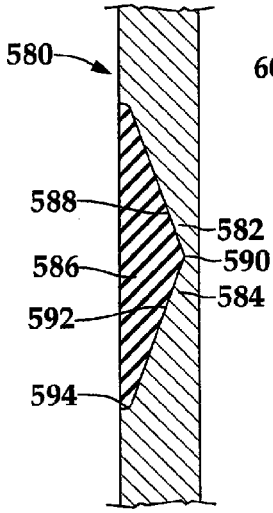
FIG. 11 is a cross sectional view of a discharge location of a carrier of a debris retention perforating apparatus of the present invention.

Referring now to FIG. 11, therein is depicted a cross sectional view of a carrier of a debris retention perforating apparatus of the present invention that is generally designated 580. Carrier 580 has a discharge location 582 which may represent a reduced wall thickness portion such as that described above with reference to FIG. 2 or a recess such as that described above with reference to FIG. 5. Discharge location 582 includes a metal layer 584 and a resilient layer 586. In the illustrated embodiment, metal layer 584 has a contoured bottom surface 588 having an apex 590. Radially outwardly extending from apex 590 is angular bottom portion 592 which extends radially outwardly toward sidewall 594. As such, the thickness of metal layer 584 is at a minimum and the thickness of resilient layer 586 is at a maximum at and around the location of jet penetration through discharge location 582.

Figure 12:
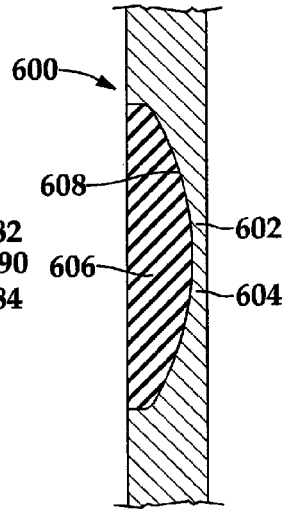
FIG. 12 is a cross sectional view of a discharge location of a carrier of a debris retention perforating apparatus of the present invention.

Referring now to FIG. 12, therein is depicted a cross sectional view of a carrier of a debris retention perforating apparatus of the present invention that is generally designated 600. Carrier 600 has a discharge location 602 which may represent a reduced wall thickness portion such as that described above with reference to FIG. 2 or a recess such as that described above with reference to FIG. 5. Discharge location 602 includes a metal layer 604 and a resilient layer 606. In the illustrated embodiment, metal layer 604 has a contoured bottom surface 608 having an arcuate contour. As such, the thickness of metal layer 604 is at a minimum and the thickness of resilient layer 606 is at a maximum at and around the location of jet penetration through discharge location 602.

Figure 13A:
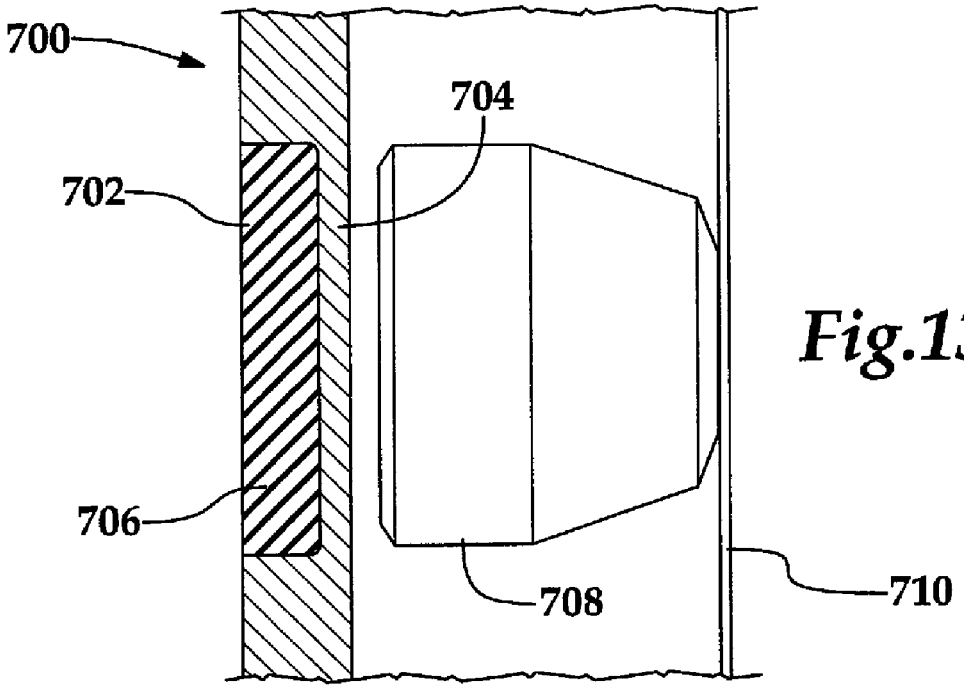
FIGS. 13A-13B are cross sectional views of a discharge location of a carrier of a debris retention perforating apparatus of the present invention, respectively before and after jet penetration therethrough.
Figure 13B:
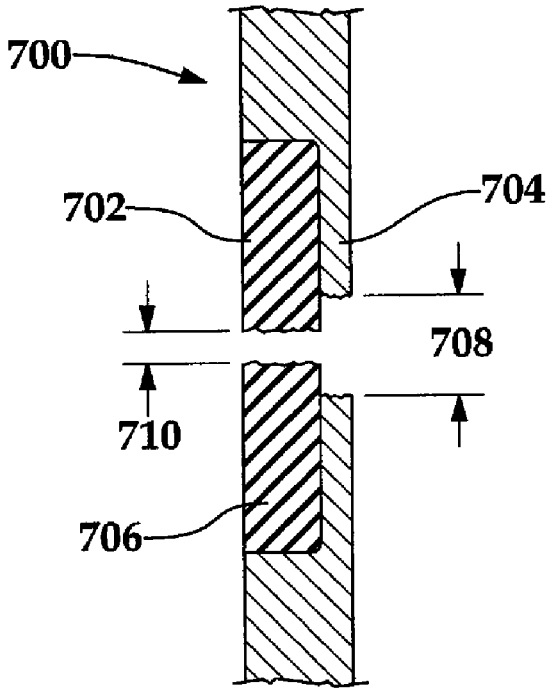

Referring now to FIGS. 13A-13B, therein is depicted a cross sectional view of a carrier of a debris retention perforating apparatus of the present invention that is generally designated 700, respectively before and after jet penetration. In FIG. 13A, carrier 700 has a discharge location 702 which may represent a reduced wall thickness portion such as that described above with reference to FIG. 2 or a recess such as that described above with reference to FIG. 5. Discharge location 702 includes a metal layer 704 and a resilient layer 706. A shaped charge 708 coupled to a detonating cord 710 is positioned within carrier 700. Upon detonation of shaped charge 708, a high speed jet is produced that penetrates through carrier 700 at discharge location 702. As illustrated in FIG. 13B, the diameter 708 of the opening made by the jet in metal layer 704 is larger than the diameter 710 of the opening made by the jet in resilient layer 706. Specifically, once the jet has completely passes through resilient layer 706, resilient layer 706 experience resilient recovery such that the openings through resilient layer 706 decreases in size and becomes smaller than the opening through metal layer 704, thereby containing more fragments within carrier 700 and reducing the debris that is left behind in the wellbore.

Figure 14A:
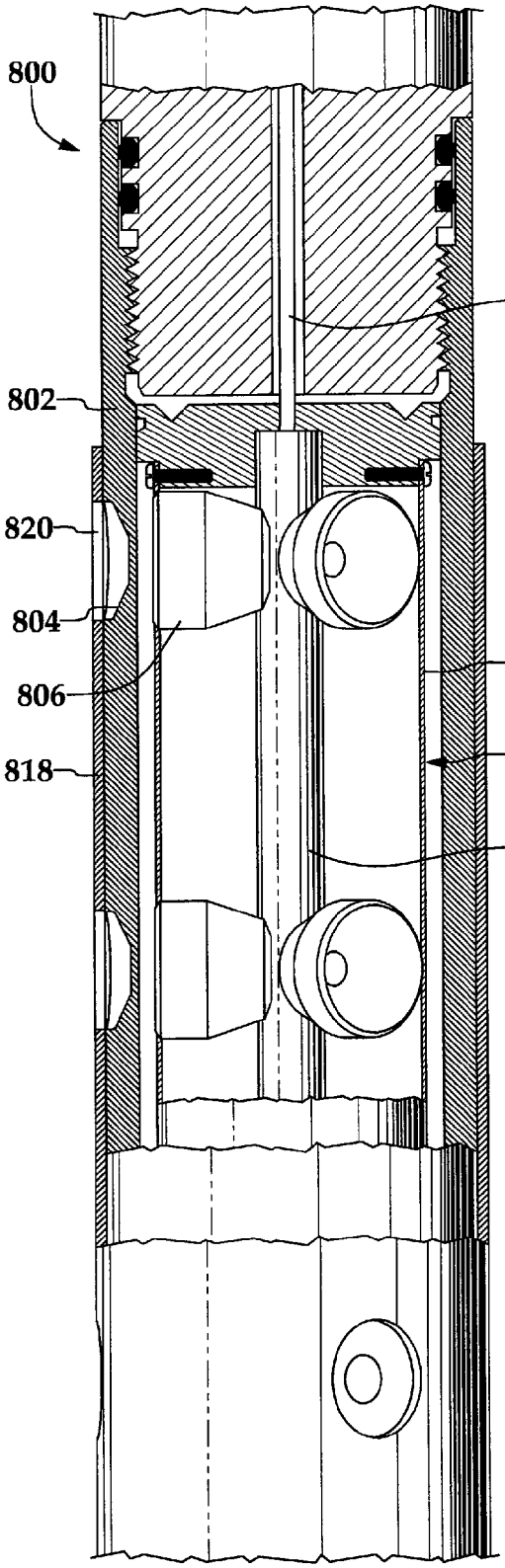
FIGS. 14A-14B are is partial cut away view of a further embodiment of a debris retention perforating apparatus of the present invention, respectively before and after operation.
Figure 14B:
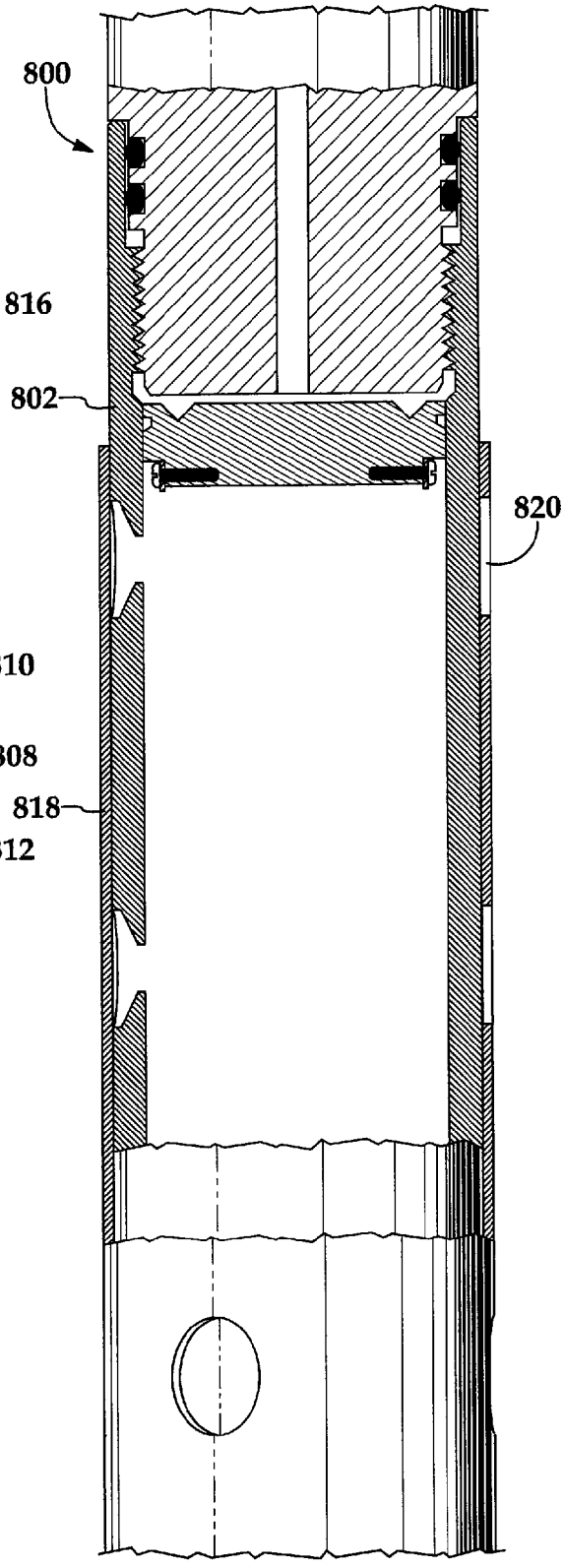

Referring next to FIGS. 14A-14B, therein is depicted a debris retention perforating apparatus of the present invention that is generally designated 800. Perforating apparatus 800 includes a carrier 802 having a plurality of recesses, such as recess 804, defined therein. Radially aligned with each of the recesses is a respective one of the plurality of shaped charges, such as shaped charge 806.

The shaped charges are retained within carrier 802 by a support member 808 which includes an outer charge holder sleeve 810 and an inner charge holder sleeve 812. In this configuration, outer tube 810 supports the discharge ends of the shaped charges, while inner tube 812 supports the initiation ends of the shaped charges. Disposed within inner tube 812 is a detonating cord 816. In the illustrated embodiment, the initiation ends of the shaped charges are operably associated with detonating cord 816 such that detonating cord 816 connects to the high explosive within the shaped charges through an aperture defined at the apex of the housings of the shaped charges. Each of the shaped charges, such as shaped charge 806, is longitudinally and radially aligned with a recess, such as recess 804, in carrier 802 when perforating apparatus 800 is fully assembled. In the illustrated embodiment, the shaped charges are arranged in a cluster pattern such that three shaped charge is disposed on the same level or height and are detonated substantially simultaneously.

Disposed about the exterior of carrier 802 is a rotatable sleeve 818 that has a plurality of opening, such as opening 820. Preferably, sleeve 818 is formed from a metal such as steel, however, sleeve 818 could alternatively be formed from other suitable materials. As illustrated in FIG. 14A, when perforating apparatus 800 is fully assembled, openings 820 of sleeve 818 are aligned with recesses 804 of carrier 802. In a preferred configuration, sleeve 818 is circumferentially biased relative to carrier 802 by a torsion spring (not pictured) or other suitable biasing device. Upon detonation, the jets formed from charges 806 pass through recesses 804 as well as openings 820 at the discharge locations of carrier 802. Following this operation, the energy stored in the torsion spring in released to rotate sleeve 818 relative to carrier 802 as illustrated in FIG. 14B, thereby retaining any fragments within carrier 802 and reducing the debris that is left behind in the wellbore.

Even though FIGS. 14A-14B have described a single sleeve that is rotatable relative to the carrier, it should be understood by those skilled in the art that a sleeve could alternatively slide axially or otherwise move relative to the carrier or more than one sleeve or sealing element could be used to cover the discharge location of the carrier following the operation of the perforating apparatus. Likewise, even though FIGS. 14A-14B have described the use of a torsion spring to provide the force necessary to move the sleeve relative to the carrier, it should be understood by those skilled in the art that other systems may be used to move the sleeve including belleville washers, electric motors or the like.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A method for retaining debris in a perforating apparatus used to perforate a subterranean well, the method comprising:

running the perforating apparatus downhole, the perforating apparatus including a carrier having at least one discharge location, the at least one discharge location having first and second material layers, the first material layer being a resilient layer and exhibiting resilient recovery;

detonating a shaped charge contained within the carrier; and discharging a jet formed from the shaped charge through the discharge location, the jet producing a smaller opening in the first material layer than the second material layer, thereby enabling the first material layer to retain more debris than the second material layer.

2. The method as recited in claim 1 wherein discharging a jet formed from the shaped charge through the discharge location further comprises producing a smaller opening in a polymeric layer than in a metal layer.

3. The method as recited in claim 1 wherein discharging a jet formed from the shaped charge through the discharge location further comprises producing a smaller opening in an elastomeric layer than in a metal layer.

4. The method as recited in claim 1 wherein discharging a jet formed from the shaped charge through the discharge location further comprises producing a smaller opening in a rubber layer than in a metal layer.

5. The method as recited in claim 1 wherein discharging a jet formed from the shaped charge through the discharge location further comprises producing a smaller opening in an interior layer than in an exterior layer.

6. The method as recited in claim 1 wherein discharging a jet formed from the shaped charge through the discharge location further comprises producing a smaller opening in an exterior layer than in an interior layer.

7. The method as recited in claim 1 further comprising positioning at least a portion of the first material layer in a circumferential groove of the carrier.

8. The method as recited in claim 1 further comprising positioning at least a portion of the first material layer in a recess of the carrier.

9. The method as recited in claim 1 further comprising positioning a sleeve of the first material around an exterior of the carrier.

10. The method as recited in claim 1 further comprising at least partially securing the first and second material layers together using a crosslinking reaction.

11. A method for retaining debris in a perforating apparatus used to perforate a subterranean well, the method comprising:

disposing at least one shaped charge within a carrier of a perforating apparatus;

orienting the shaped charge such that a discharge end of the shaped charge is aligned with a discharge location of the carrier; and forming the discharge location of the carrier from first and second material layers, the first material layer being a resilient layer and exhibiting resilient recovery such that a jet formed upon detonation of the shaped charge produces a smaller opening in the first material layer than the second material layer, thereby enabling the first material layer to retain more debris than the second material layer.

12. The method as recited in claim 11 wherein the jet produces a smaller opening in a polymeric layer than in a metal layer.

13. The method as recited in claim 11 wherein the jet produces a smaller opening in an elastomeric layer than in a metal layer.

14. The method as recited in claim 11 wherein the jet produces a smaller opening in a rubber layer than in a metal layer.

15. The method as recited in claim 11 wherein the jet produces a smaller opening in an interior layer than in an exterior layer.

16. The method as recited in claim 11 wherein the jet produces a smaller opening in an exterior layer than in an interior layer.

17. The method as recited in claim 11 wherein forming the discharge location further comprises positioning at least a portion of the first material layer in a circumferential groove of the carrier.

18. The method as recited in claim 11 wherein forming the discharge location further comprises positioning at least a portion of the first material layer in a recess of the carrier.

19. The method as recited in claim 11 wherein forming the discharge location further comprises positioning a sleeve of the first material around an exterior of the carrier.

20. The method as recited in claim 11 wherein forming the discharge location further comprises at least partially securing the first and second material layers together using a crosslinking reaction.

* * * * *